US012097554B2

(12) United States Patent
Nikkuni et al.

(10) Patent No.: US 12,097,554 B2
(45) Date of Patent: Sep. 24, 2024

(54) SLAB CASTING METHOD

(71) Applicant: NIPPON STEEL CORPORATION, Tokyo (JP)

(72) Inventors: Daisuke Nikkuni, Tokyo (JP); Toshiyuki Shiraishi, Tokyo (JP); Yutaka Sadano, Tokyo (JP); Masafumi Miyazaki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 688 days.

(21) Appl. No.: 17/283,131

(22) PCT Filed: Oct. 21, 2019

(86) PCT No.: PCT/JP2019/041336
§ 371 (c)(1),
(2) Date: Apr. 6, 2021

(87) PCT Pub. No.: WO2020/085313
PCT Pub. Date: Apr. 30, 2020

(65) Prior Publication Data

US 2021/0387249 A1 Dec. 16, 2021

(30) Foreign Application Priority Data

Oct. 22, 2018 (JP) ..... 2018-198355

(51) Int. Cl.
*B22D 11/16* (2006.01)
*B21B 1/46* (2006.01)
(Continued)

(52) U.S. Cl.
CPC ..... *B22D 11/168* (2013.01); *B21B 1/463* (2013.01); *B21B 39/14* (2013.01);
(Continued)

(58) Field of Classification Search
CPC ..... B22D 11/0622; B22D 11/168
See application file for complete search history.

(56) References Cited

U.S. PATENT DOCUMENTS 5,191,927 A 3/1993 Terado et al.

FOREIGN PATENT DOCUMENTS

FR 2610227 B1 * 4/1990
FR 2699438 A1 * 6/1994 ..... B21B 38/105
(Continued)

*Primary Examiner* — Kevin E Yoon
*Assistant Examiner* — Jacky Yuen
(74) *Attorney, Agent, or Firm* — Myers Wolin, LLC

(57) ABSTRACT

A slab casting method using a twin-drum continuous casting device manufactures a slab by solidifying molten metal by a pair of rotating casting drums includes calculating estimated sheet thicknesses on both ends in a width direction of the slab from equation 1 ((estimated sheet thickness)=(cylinder screw down position)+(elastic deformation of casting drum)+(casting drum housing screw down system deformation)+(drum profile of casting drum)−(elastic deformation of casting drum at the time of screw down position zero adjustment)) by using a casting drum housing screw down system deformation characteristic indicating a deformation characteristic of housings that support the casting drums and a deformation characteristic of a screw down system that screws down the casting drums obtained before casting of the slab starts, and controlling screw down positions of cylinders provided on both ends in a width direction of the casting drums.

2 Claims, 8 Drawing Sheets

(51) Int. Cl.

| | |
|---|---|
| ***B21B 39/14*** | (2006.01) |
| ***B22D 11/06*** | (2006.01) |
| ***B22D 11/12*** | (2006.01) |

(52) U.S. Cl.
CPC ..... *B22D 11/0622* (2013.01); *B22D 11/1226* (2013.01); *B21B 2261/04* (2013.01)

(56) References Cited

FOREIGN PATENT DOCUMENTS

| | | | |
|---|---|---|---|
| JP | S58-173837 | A | 10/1983 |
| JP | S60-30508 | A | 2/1985 |
| JP | S60-83746 | A | 5/1985 |
| JP | S60-83747 | A | 5/1985 |
| JP | S62-123658 | A | 6/1987 |
| JP | H01-166863 | A | 6/1989 |
| JP | H04-187345 | A | 7/1992 |
| JP | H06-106305 | A | 4/1994 |
| JP | 2008-213014 | A | 9/2008 |
| JP | 2017-196636 | A | 11/2017 |
| WO | 2008/106744 | A1 | 9/2008 |

* cited by examiner

SLAB CASTING METHOD

CROSS-REFERENCE TO RELATED APPLICATION

This application is a National Phase of PCT/JP2019/041336, filed on Oct. 21, 2019, and which designated the U.S., which claims priority to Japanese Patent Application No. 2018-198355, filed on Oct. 22, 2018. The contents of each are wholly incorporated herein by reference.

TECHNICAL FIELD

The present disclosure relates to a slab casting method.

Priority is claimed on Japanese Patent Application No. 2018-198355, filed in Japan on Oct. 22, 2018, the content of which is incorporated herein by reference.

RELATED ART

For manufacturing a metal ribbon (hereinafter referred to as a slab), for example, as disclosed in Patent Document 1, a twin-drum continuous casting device is used. In the twin-drum continuous casting device, a pair of casting drums for continuous casting (hereinafter referred to as casting drums) are arranged in parallel, facing peripheral surfaces thereof are rotated from above downward, molten metal is injected into a pool formed of the peripheral surfaces of the casting drums, and the molten metal is cooled to be solidified on the peripheral surfaces of the casting drums to continuously cast a metal ribbon. The pair of casting drums press the slab with a predetermined pressing force while maintaining parallelism of rotation axes during casting. A reaction force from the slab to the casting drum changes depending on a solidification state and may become non-uniform in a width direction, and it is difficult to strictly maintain the parallelism of the rotation axes of the pair of casting drums. For this reason, there is a case where a difference in sheet thickness between both ends in the width direction, a so-called wedge, occurs in the slab. When the wedge occurs, meandering may occur at a rolling step arranged downstream of the casting drum, which may cause a rolling defect.

For example, as a method of suppressing the occurrence of the wedge, Patent Document 1 discloses a technology of adjusting a crown and a wedge of a slab by controlling opening/closing, an intersecting angle, and an offset amount of casting drums while maintaining a state in which a pair of casting drums are parallel to each other.

Patent Document 2 discloses a screw down control method of a twin-drum continuous casting machine that pours molten metal into a surface gap between two drums having parallel rotation axes that rotate in directions opposite to each other while maintaining an arbitrary gap to cast a sheet. In this method, pressing forces at both ends of one drum are detected and added, and, by a signal based on this, both ends of the other drum are moved in parallel by a hydraulic cylinder so that the sum of the pressing forces at both ends of the one drum becomes a predetermined value, so that a wedge is reduced.

Patent Document 3 discloses a sheet ribbon continuous casting method of continuously manufacturing a sheet ribbon by pouring molten metal between a pair of rotating rolls or on any one roll side and compressing a solidified shell of the molten metal formed on the roll side being a long side by twin rolls. In this method, a sheet thickness is controlled by detecting a compressive load acting on the rotating rolls and controlling a solidification time between the rolls so that this value becomes a target value.

Patent Document 4 discloses a technology of continuously measuring a screw down load when solidified shells are crimpled in a gap between a roll pair and controlling a rotation speed of the roll pair so that the measured screw down load is maintained at a target load. In such method, a sheet thickness is controlled by controlling the rotation speed of the roll pair.

Patent Document 5 discloses a screw down setting control method of a rolling mill in which a mill stretch is predicted while separating the deformation of the same into the amount of deformation contributed by each roll and the amount contributed by other processes than the roll deformation and a sheet thickness is estimated when obtaining the sheet thickness in a case where a sheet thickness meter is not installed.

CITATION LIST

Patent Document

[Patent Document 1]
Japanese Unexamined Patent Application, First Publication No. 2017-196636
[Patent Document 2]
Japanese Patent Application, First Publication No. S62-323710
[Patent Document 3]
Japanese Unexamined Patent Application, First Publication No. S58-173837
[Patent Document 4]
Japanese Unexamined Patent Application, First Publication No. S62-123658
[Patent Document 5]
Japanese Unexamined Patent Application, First Publication No. S60-030508

SUMMARY OF INVENTION

Problems to be Solved

However, in order to control a wedge with higher accuracy, in the technology disclosed in Patent Document 1, it is required to install a thickness distribution meter and the like for measuring a sheet thickness downstream in a casting direction of the casting drum, and feed back a measurement result to a cylinder position and the like of the casting drum, thereby controlling the sheet thickness. When installing the thickness distribution meter, it is desirable to install the same as close as possible to the casting device in order to reduce a wasted time. However, if the thickness distribution meter is installed directly below the casting device, there is a case where molten metal falls on the thickness distribution meter to damage the same in a case where extraction of the molten metal fails. Therefore, the thickness distribution meter needs to be installed in a position at a distance from the casting drum. According to this, the wasted time becomes large, so that it is difficult to perform feedback control of the wedge with high accuracy according to the measured sheet thickness.

In the technology disclosed in Patent Document 2, rigidity of the casting drum is not always equal at both ends, and even if the casting drum is moved in parallel by a hydraulic cylinder so as to make the sum of the pressing forces a target value, the wedge is not always reduced.

An object of the technology disclosed in Patent Document 3 is to control an average sheet thickness of a material, so that the average sheet thickness may be kept within a predetermined range; however the wedge cannot be reduced.

In the technology disclosed in Patent Document 4, an average sheet thickness of a slab may be kept within a predetermined range but the wedge cannot be reduced as in the technology disclosed in Patent Document 3.

The present disclosure is achieved in view of the above-described problems, and an object thereof is to provide a novel and improved slab casting method capable of reducing a wedge more accurately.

(1) In a slab casting method according to an aspect of the present disclosure, by using a twin-drum continuous casting device that manufactures a slab by solidifying molten metal by a pair of rotating casting drums, estimated sheet thicknesses on both ends in a width direction of the slab are calculated from following equation 1 by using a casting drum housing screw down system deformation characteristic indicating a deformation characteristic of housings that support the casting drums and a deformation characteristic of a screw down system that screws down the casting drums obtained before casting of the slab starts, and screw down positions of cylinders provided on both ends in a width direction of the casting drums are controlled so that the difference in estimated sheet thickness between both the ends becomes a predetermined value or smaller.

In equation 1, a cylinder screw down position and casting drum housing screw down system deformation indicate the difference from at the time of screw down position zero adjustment, respectively: (estimated sheet thickness)=(cylinder screw down position)

(Estimated sheet thickness)=(cylinder screw down position)+(elastic deformation of casting drum)+(casting drum housing screw down system deformation)+(drum profile of casting drum)−(elastic deformation of casting drum at the time of screw down position zero adjustment) equation 1

With the above-described configuration, the estimated sheet thicknesses on both ends in the width direction of the slab is calculated, and the screw down positions of the cylinders provided on both ends of the casting drum are controlled so that a difference between the estimated sheet thicknesses becomes a predetermined value or smaller, so that it is possible to cast the slab with a shorter wasted time than that when actually measuring the slab after casting and controlling the sheet thickness of the slab at the time of casting.

(2) In the slab casting method according to (1) described above, the casting drum housing screw down system deformation characteristic may be obtained on the basis of the cylinder screw down positions and a load obtained by tightening in a state of opening a pair of side weirs provided on ends in the width direction of the casting drums and interposing a sheet with a uniform sheet thickness longer in sheet width than a drum length of the casting drums between the casting drums.

(3) In the slab casting method according to (1) or (2) described above, the screw down position zero adjustment of the casting drums may be performed in a state of opening a pair of side weirs provided on ends in the width direction of the casting drums and interposing a sheet with a uniform sheet thickness longer in sheet width than the drum length of the casting drums between the casting drums.

Effects

As described above, according to the present disclosure, the wedge of the slab may be reduced more accurately.

DETAILED DESCRIPTION

An embodiment of the present disclosure is hereinafter described with reference to the drawings. Note that, in this specification and the drawings, components having substantially the same functional configuration are assigned with the same reference sign, and the description thereof is not repeated.

Note that, in this specification, a numerical value range indicated by using "to" is intended to mean a range including numerical values before and after "to" as a lower limit value and an upper limit value, respectively. In this specification, the term "step" includes not only an independent step but also a step at which an intended object of the step is achieved even in a case where this cannot be clearly distinguished from other steps. It is obvious that respective components of the following embodiment may be combined with each other.

<Overview of Slab Casting Method>

First, with reference to FIGS. 1 to 5, an outline of a slab casting method is described with reference to an example of a continuous casting facility that manufactures a slab.

(Continuous Casting Facility)

Figure 1:
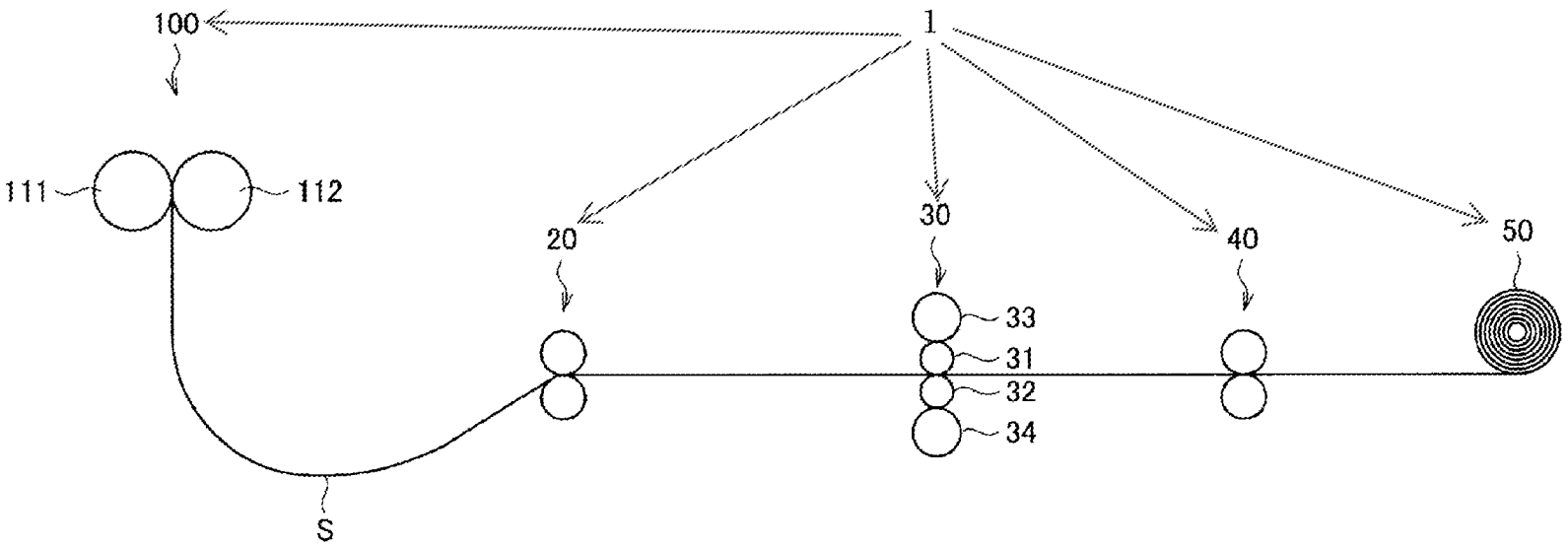
FIG. 1 is a schematic cross-sectional view illustrating a continuous casting facility according to an embodiment of the present disclosure.

First, an outline of a slab casting method using a continuous casting facility 1 is described with reference to FIG. 1. FIG. 1 is a view illustrating an example of the continuous casting facility 1 to which the present disclosure is applied. The continuous casting facility 1 is provided with a twin-drum continuous casting device 100 (hereinafter referred to as a continuous casting device 100), a first pinch roll 20, a rolling mill 30, a second pinch roll 40, and a coiling device 50.

The continuous casting device 100 includes a pair of casting drums including a first casting drum 111 and a second casting drum 112. The pair of casting drums are arranged so as to face each other in parallel in a horizontal direction. The continuous casting device 100 rotates the first casting drum 111 and the second casting drum 112 in different circumferential directions R1 and R2 so that facing surfaces of the pair of casting drums are fed downward, injects molten metal into a pool formed by peripheral surfaces of the casting drums, and cool to solidify the molten metal on the peripheral surfaces of the casting drums to continuously cast a slab S.

Figure 2:
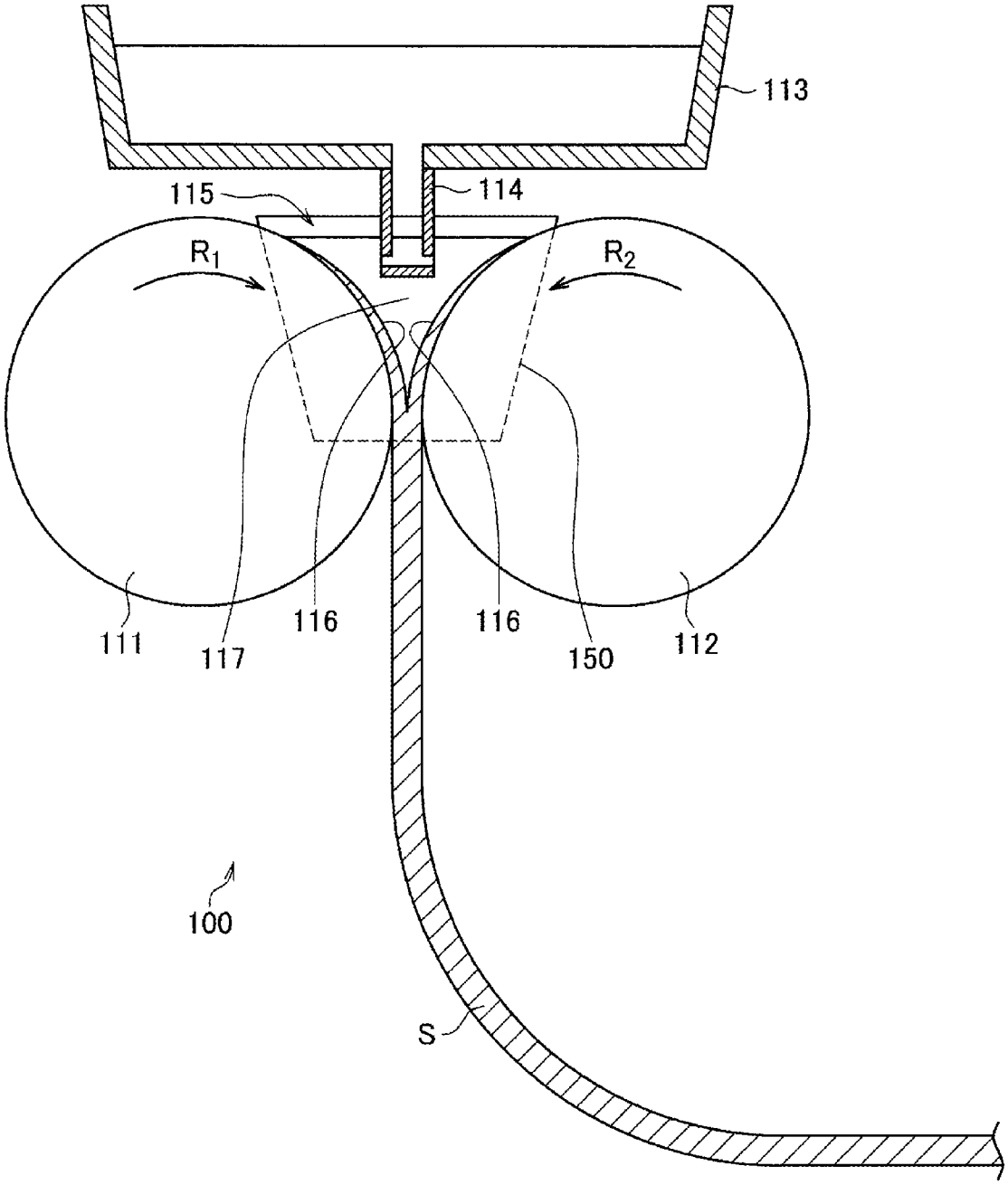
FIG. 2 is a schematic view illustrating an example of a configuration of a casting drum.

The continuous casting device 100 is described in detail with reference to FIG. 2. FIG. 2 is a view illustrating the continuous casting device 100 in detail in an axial direction of the casting drum. As illustrated in FIG. 2, the continuous casting device 100 is provided with the pair of casting drums provided with the first casting drum 111 and the second casting drum 112, side weirs 150 arranged on ends in a width direction of the pair of first casting drum 111 and second casting drum 112, a tundish 113 that holds molten metal 117 supplied to a molten metal pool 115 defined by the pair of first casting drum 111 and second casting drum 112 and the side weirs 150, and an immersion nozzle 114 that supplies the molten metal 117 from the tundish 113 to the molten metal pool 115.

In such continuous casting device 100, the molten metal 117 comes into contact with the first casting drum 111 and the second casting drum 112 that rotate to be cooled, so that a solidified shell 116 grows on each of the peripheral surfaces of the first casting drum 111 and the second casting drum 112, and the solidified shells 116 formed on the pair of casting drums are crimped at a closest point of the pair of casting drums and the slab S having a predetermined thickness is cast.

In the continuous casting device 100, temperature of the casting drum is low before the casting starts in general. When the casting starts, the temperature of the casting drum rises due to contact with hot molten metal. The casting drum is also cooled from inside by a cooling medium (for example, cooling water) so as not to reach certain temperature or higher. A period after the temperature of the casting drum reaches constant temperature is referred to as a steady casting period, and the temperature of the casting drum in the steady casting period is referred to as steady temperature.

Here, as illustrated in FIG. 1, the slab S cast by the continuous casting device 100 is delivered to the rolling mill 30 by the first pinch roll 20.

The rolling mill 30 rolls the slab S to a desired sheet thickness. The rolling mill 30 is provided with an upper work roll 31 and a lower work roll 32, and an upper backup roll 33 and a lower backup roll 34 that support the upper work roll 31 and the lower work roll 32, respectively.

The slab S rolled to the desired sheet thickness by the rolling mill 30 is delivered to the coiling device 50 by the second pinch roll 40, and is coiled into a coil by the coiling device 50.

Figure 3:
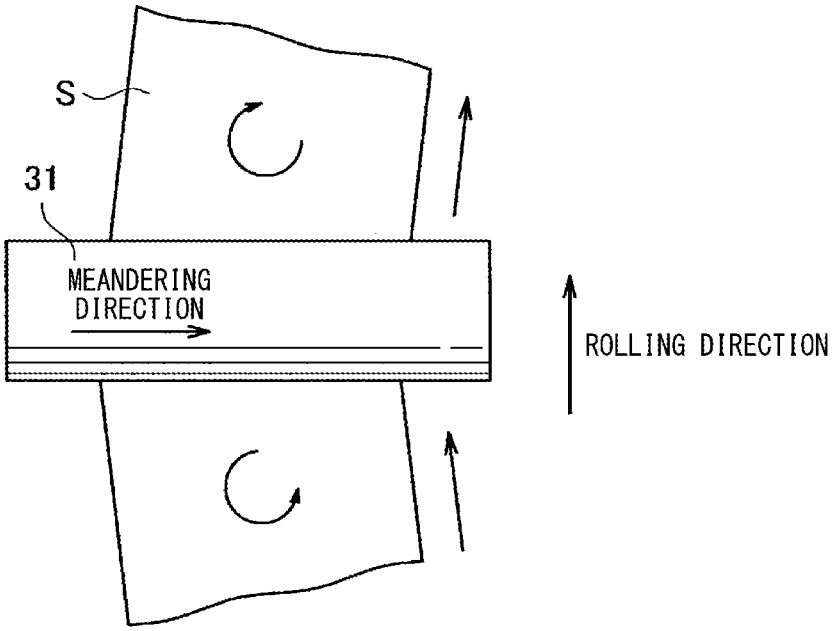
FIG. 3 is a schematic plan view illustrating a state of meandering of a slab S in a rolling mill.

(Meandering in Rolling Mill) In the rolling mill 30 of the continuous casting facility 1 as described above, there is a case where meandering occurs in which a threading position of the slab S moves in a direction perpendicular to a rolling direction. Here, FIG. 3 is a schematic plan view illustrating a meandering state of the slab S in the rolling mill 30, the view of a sheet surface of the slab S as seen from a side of the upper work roll 31. The slab S rolled by the upper work roll 31 and the lower work roll 32 does not advance parallel to the rolling direction but meanders. Such meandering occurs when one side and the other side are asymmetrically rolled in a width direction of the upper work roll 31 and the lower work roll 32. Note that one side and the other side of the rolling mill may mean a drive side on which a motor of the rolling mill to be described later drives and a work side opposite to the drive side.

Figure 4:
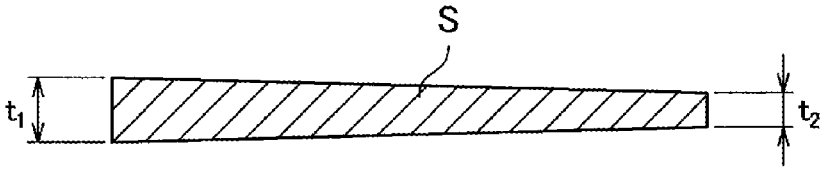
FIG. 4 is a schematic view illustrating a cross-section of an example of the slab in which the meandering occurs in the rolling mill.

Such meandering of the slab S may occur due to a shape in the sheet thickness of the slab S before being rolled by the rolling mill 30. FIG. 4 illustrates an example of a cross-sectional view of the slab in which the meandering occurs in a longitudinal direction (conveying direction). In the slab S, a sheet thickness $t_1$ on one end is larger than a sheet thickness $t_2$ on the other end, and the sheet thickness gradually changes from the one end to the other end in the width direction. When such slab S having a non-uniform sheet thickness is rolled, a portion with a large sheet thickness is stretched larger than a portion with a small sheet thickness. Reduction ratio is larger on the end with the sheet thickness $t_1$ than on the end with the sheet thickness $t_2$ on an entry side. In this case, a material speed on the entry side is lower on the end with the sheet thickness $t_1$ than on the end with the sheet thickness $t_2$, and the meandering occurs due to a difference in speed on the entry side between the one end and the other end of the slab S, that is, the occurrence of rotation in plane of the slab S.

More specifically, since the total amount of the material of the slab S is the same on the entry side and an exit side of the rolling mill, a value obtained by multiplying the speed and the sheet thickness of the slab S is the same on the entry side and the exit side of the rolling mill. At that time, in a case where the sheet thickness on the exit side is uniform in the width direction, if there is a difference in sheet thickness between the one end and the other end of the slab S on the entry side of the rolling mill, a difference in reduction ratio occurs; for example, the speed on the end with a large sheet thickness on the entry side becomes lower than that on the end with a small sheet thickness on the entry side. As a result, the end at a high speed on the entry side is drawn into a work roll faster than the end at a low speed on the entry side to be rolled, rotation occurs in the slab S, and the meandering in the rolling mill occurs.

Although it is described in detail regarding occurrence of a wedge being a difference between the sheet thicknesses $t_1$ and $t_2$ illustrated in FIG. 4, the wedge occurs because the wedge is not reduced with accuracy in the casting drum when the slab S is cast by the continuous casting device 100 arranged at an upper step of the rolling mill 30. Therefore, in order to reduce the meandering in the rolling mill 30, it is effective to reduce with accuracy the wedge occurring in the continuous casting device 100.

(Occurrence of Wedge in Casting Drum)

Figure 5:
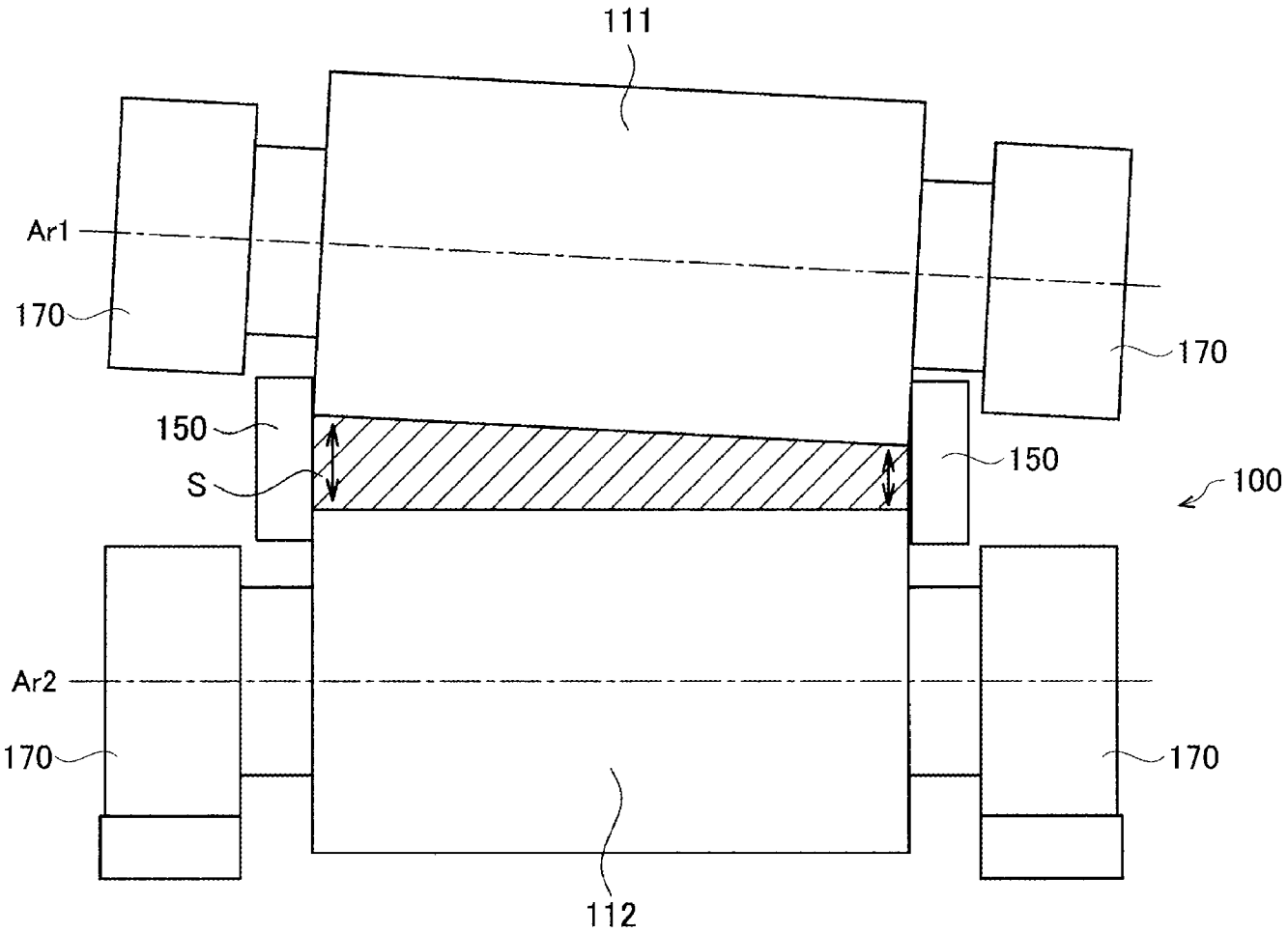
FIG. 5 is a schematic view illustrating occurrence of a wedge in the casting drum.

The occurrence of the wedge in the continuous casting device 100 is described with reference to FIG. 5. FIG. 5 is a plan view of the continuous casting device 100 as seen from directly above the continuous casting device 100 in a casting direction.

FIG. 5 is a view illustrating a state of the continuous casting device 100 in a case where the wedge occurs in the slab S. As illustrated in FIG. 5, when the slab S is cast in a state in which a rotary axis Ar1 and a rotary axis Ar2 of the first casting drum 111 and the second casting drum 112, respectively, are not parallel to each other, the sheet thickness of the slab S changes in the width direction as illustrated in FIG. 5 and the wedge occurs.

Figure 6:
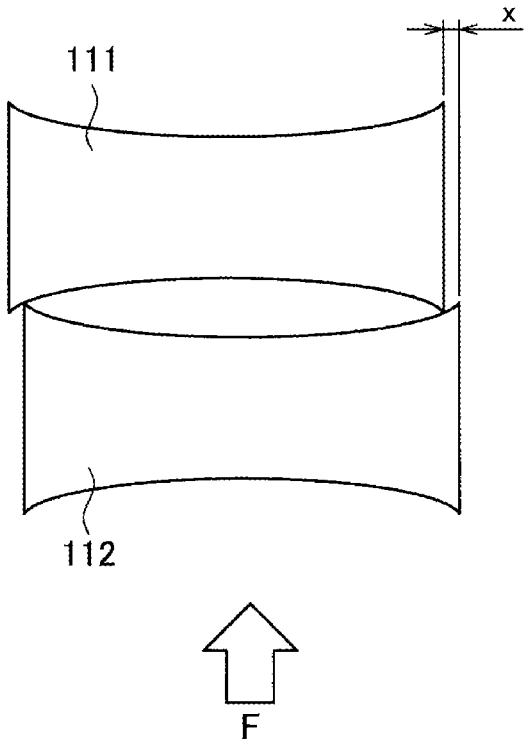
FIG. 6 is a schematic view illustrating an example of screw down position zero adjustment of the casting drum.
Figure 7:
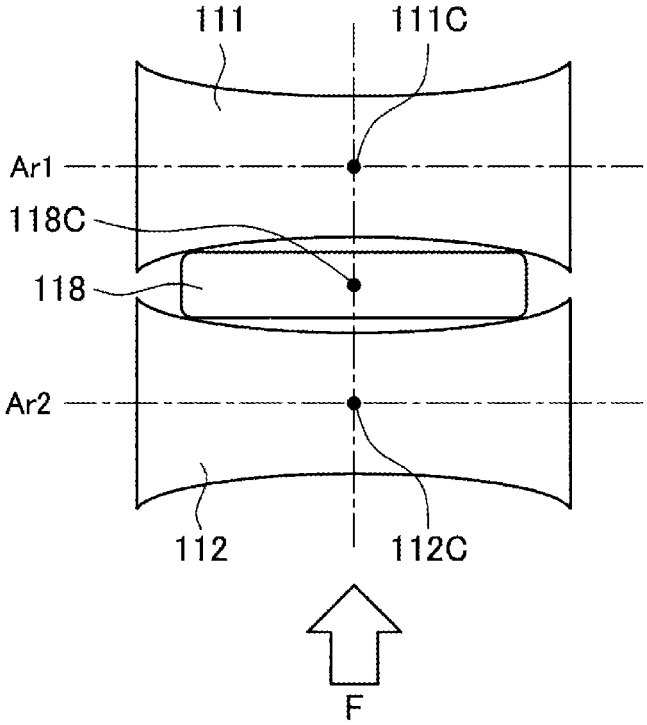
FIG. 7 is a schematic view illustrating an example of screw down position zero adjustment of the casting drum.
Figure 8:
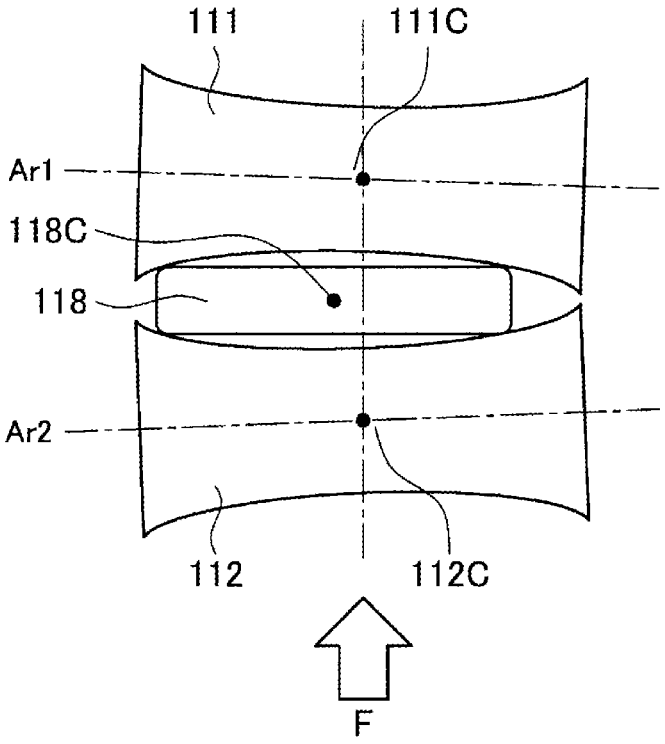
FIG. 8 is a schematic view illustrating an example of screw down position zero adjustment of the casting drum.

Here, with reference to FIGS. 6 to 8, an example of a factor in which it is cast without the rotary axes of the first casting drum 111 and the second casting drum 112 parallel to each other is described. FIGS. 6 to 8 are views schematically illustrating the casting drums at the time of screw down position zero adjustment before the casting starts as seen from directly above the casting drums in the casting direction of the casting drums.

As illustrated in FIGS. 6 to 8, a sheet profile of the casting drum before the casting starts has a concave shape in a sheet width direction. In FIGS. 6 to 8, the concave shape of the profile is emphasized for description. This is because the first casting drum 111 and the second casting drum 112 thermally expand to change over time from the start of the casting to arrival at the steady casting period. In the casting drum, an initial profile of the casting drum is set such that a sheet profile (crown) of a metal ribbon at the steady casting period in which the thermal expansion is observed becomes a desired sheet profile. Specifically, this is set to a concave crown in which a drum diameter at a width center of the casting drum is made smaller than the drum diameter on both ends of the casting drum.

In the casting drum to which such concave crown is applied, the screw down position zero adjustment is performed while setting a screw down position (pressing position) when the pair of casting drums are brought into contact with (kiss) each other and a predetermined load F is applied to zero. By the screw down position zero adjustment, an initial value and the like of a screw down position of a cylinder that screws down the casting drum may be set.

However, to the casting drum, the concave crown is applied as described above. Therefore, in a case where the casting drums are brought into contact with (kiss) each other and the predetermined load F is applied to the casting drums, only both ends of the casting drums come into contact with each other. Therefore, for example, in a case where positions of the casting drums in a width direction do not completely coincide with each other as illustrated in FIG. 6, when the predetermined load F is applied to the casting drums, contact points of both ends of the first casting drum 111 and both ends of the second casting drum 112 are displaced, so that a displacement amount x is generated and it is put into an unstable state. Therefore, the accuracy of the screw down position zero adjustment is deteriorated.

In order to avoid this, at the time of screw down position zero adjustment using the casting drums to which the concave crown is applied, as illustrated in FIG. 7, the screw down position zero adjustment with a sheet 118 interposed between the casting drums is performed. FIG. 7 illustrates an example in which a midpoint 118C of a length in a width direction of the sheet 118 is arranged on a straight line connecting midpoints 111C and 112C of a length in a width direction of the first casting drum 111 and the second casting drum 112 and displacement does not occur on both ends of the casting drums. Without the displacement, the rotation axis Ar1 and the rotation axis Ar2 of the first casting drum 111 and the second casting drum 112, respectively, are parallel to each other, so that the screw down position zero adjustment may be stably performed.

However, even in a case where the screw down position zero adjustment is performed with the sheet 118 interposed between the casting drums, there is a case where the intermediate point 118C of the length in the width direction of the sheet 118 is not arranged on the straight line connecting the intermediate points 111C and 112C of the length in the width direction of the first casting drum 111 and the second casting drum 112, respectively, and the sheet 118 is arranged closer to either end in the width direction of the casting drum as illustrated in FIG. 8. In this case, since the rotation axis Ar1 and the rotation axis Ar2 of the first casting drum 111 and the second casting drum 112, respectively, are not parallel to each other, even when the screw down position zero adjustment is performed, there is an error between right and left sides (both ends in the width direction of the first casting drum 111 and the second casting drum 112). When the casting is performed in such state, in a case of controlling by the cylinder screw down position, the wedge occurs in the slab to be cast.

In order to reduce the occurrence of the meandering of the slab when passing through the rolling mill, the present inventors have studied a method of estimating the sheet thickness of the slab to be cast by the casting drums on both ends in the width direction of the slab and controlling the sheet thickness of the slab to be cast on the basis of the estimated sheet thickness in order to reduce the above-described wedge.

The estimation of the sheet thickness is herein described. For example, as disclosed in Patent Document 5, in the rolling mill, there is a case of estimating the sheet thickness while separating the deformation into the amounts of deformation contributed by each work roll and the amount of deformation contributed by other than the work roll when obtaining the sheet thickness in a case where a sheet thickness meter is not installed and the like. Specifically, in the rolling mill, the length in a width direction of the work roll is longer than the sheet width of the slab, gaps on both ends in the width direction between the work rolls in the rolling mill are estimated, and a sheet thickness at the center of a roll barrel is obtained using an average of the gaps on both ends. In the rolling mill, a load may be stably applied at the time of screw down position zero adjustment, so that the screw down position zero adjustment may be performed without error, and the sheet thickness at the center of the slab may be estimated with accuracy by using the gaps on both ends in this manner.

However, in the rolling mill, it is not possible to grasp the position of the slab delivered from the continuous casting device in a width direction of the rolling mill. Therefore, even when the gap between the work rolls in the rolling mill may be estimated, it is not possible to grasp the positions of the gaps corresponding to both ends of the slab, and the sheet thicknesses on both ends of the slab cannot be estimated. Therefore, in the rolling mill, it was not possible to estimate the wedge of both ends of the slab using the estimated sheet thickness.

On the other hand, in the casting drum, as illustrated in FIG. 5, the slab is cast while being surrounded by the first casting drum 111, the second casting drum 112, and the side weirs 150 provided on both ends in the width direction of the casting drum. Therefore, the length in the width direction of the slab and that of the casting drum (barrel length) are the same. Focusing on this event, the present inventors applied the sheet thickness estimation in the rolling mill to the casting drum, and achieved that the wedge may be reduced by estimating the sheet thickness on both ends of the slab and controlling a pressing means of the casting drum on the basis of the estimated sheet thickness.

(Configuration of Continuous Casting Device)

Figure 9:
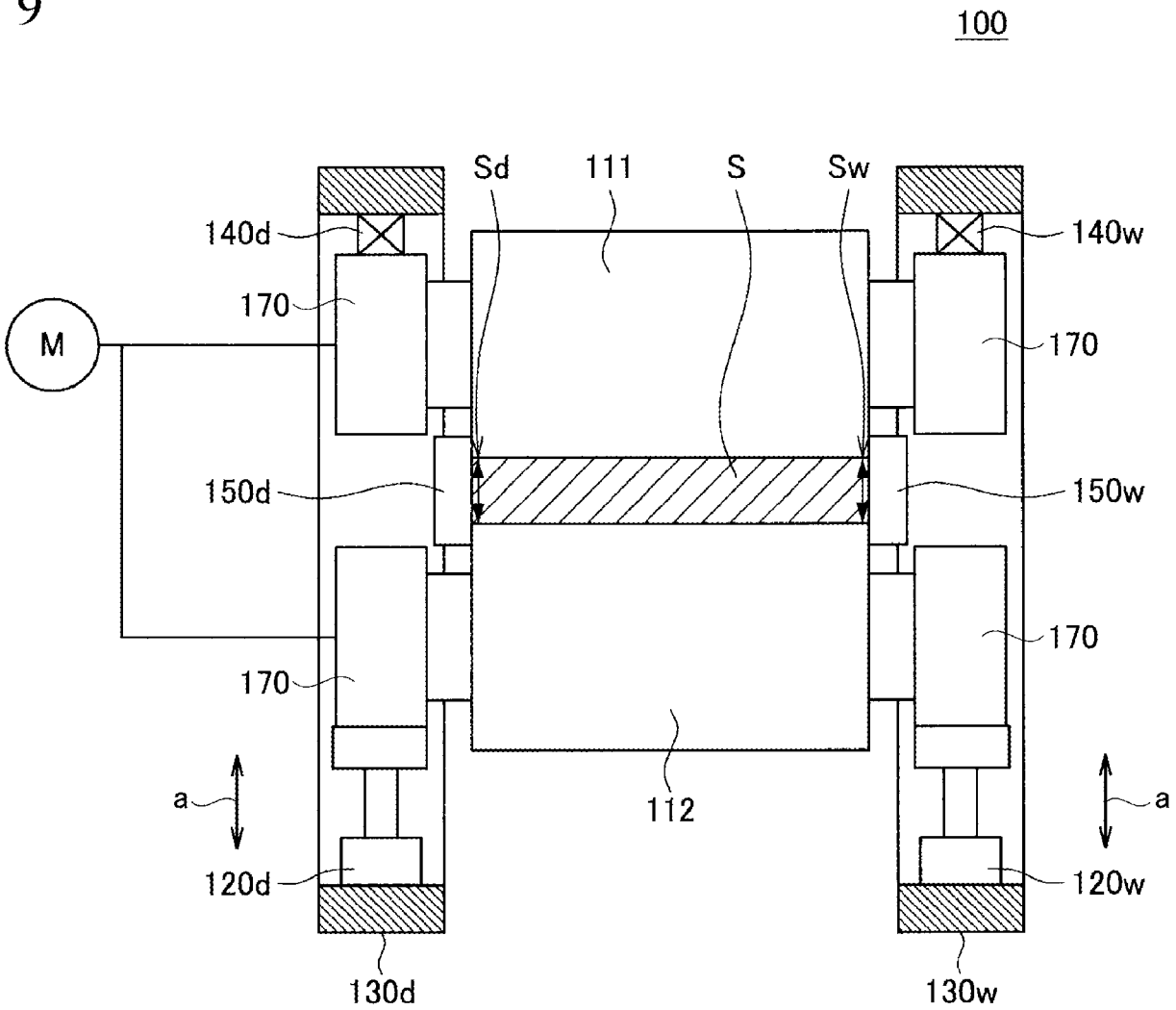
FIG. 9 is a schematic view illustrating an example of a configuration of the casting drum.

A configuration example of the casting drums for carrying out the slab casting method according to an embodiment of the present disclosure is described with reference to FIG. 9. FIG. 9 is a plan view illustrating an example of a detailed configuration of the continuous casting device as seen from directly above in the casting direction.

The first casting drum 111 and the second casting drum 112 are arranged so as to face each other in the horizontal direction, and the slab is cast between the first casting drum 111 and the second casting drum 112. The first casting drum 111 and the second casting drum 112 rotate by drive of a motor M to deliver the slab S downstream in the casting direction. Hereinafter, in this specification, in the width direction of the casting drum of the continuous casting device 100, a drive side by the motor M is referred to as a drive side DS, and a side opposite to the drive side is referred to as a work side WS. Hereinafter, it is described while setting a value obtained by subtracting a sheet thickness $t_{ws}$ on the work side WS from a sheet thickness $t_{DS}$ on the drive side DS to a wedge ($t_{DS}$-$t_{WS}$).

In the continuous casting device 100, a side weir 150*d* and a side weir 150*w* are provided so as to surround a gap formed by the first casting drum 111 and the second casting drum 112 facing each other on both ends in the width direction of the first casting drum 111 and the second casting drum 112. The molten metal is stored in a region surrounded by the first casting drum 111, the second casting drum 112, the side weir 150*d*, and the side weir 150*w*, and the slab S is sequentially cast.

Both ends of shafts in the width direction of the first casting drum 111 and the second casting drum 112 are supported by a housing 130*d* and a housing 130*w*. Both ends of the shaft in the width direction of the second casting drum 112 are connected to a cylinder 120*d* and a cylinder 120*w* on a side opposite to a side on which the first casting drum 111 is arranged in a direction in which the casting drums face each other. The cylinder 120*d* and the cylinder 120*w* are movable in the direction in which the casting drums face each other. The second casting drum 112 is screwed down on both ends of the second casting drum 112 by the cylinder 120*d* and the cylinder 120*w* toward the side on which the first casting drum 111 is arranged in the direction in which the casting drums face each other. Note that the cylinder 120*d* and the cylinder 120*w* may independently perform screw down control on both ends of the second casting drum 112.

On both ends of the shaft of the first casting drum 111, a load cell 140*d* and a load cell 140*w* for measuring a load applied to the first casting drum 111 are provided on the side opposite to the side on which the cylinder 120*d* and the cylinder 120*w* are arranged. According to this, the load by the screw down by the cylinder 120*d* and the cylinder 120*w* may be measured.

(Estimation of Sheet Thickness)

Next, a method of estimating sheet thicknesses on both ends represented by a drive side end Sd and a work side end Sw of the slab cast by the continuous casting device 100 described above is described. The end Sd of the slab and the end Sw of the slab represent end regions at least including one end of the casting drum.

As an example of sheet thickness estimation, the sheet thickness estimation of the end Sd of the slab is herein described as an example. The sheet thickness is estimated from the drum gap between the casting drums. The drum gap between the casting drums changes by the load applied to the casting drum, contact with the slab and the like in addition to the change by the cylinder screw down position. The change in the drum gap by the load applied to the casting drum, the contact with slab and the like may be considered while being separated to an amount of contribution of elastic deformation of the casting drum, an amount of contribution of elastic deformation of other than the drum, and an amount of contribution of a change in drum profile of the casting drum. The amount of contribution of the elastic deformation of other than the casting drum is referred to as casting drum housing screw down system deformation. On the basis of these elastic deformation amounts and the cylinder screw down position, the estimated sheet thickness of the end Sd may be estimated by the following equation 1.

(Estimated sheet thickness)=(cylinder screw down position)+(elastic deformation of casting drum)+(casting drum housing screw down system deformation)+(drum profile of casting drum)−(elastic deformation of casting drum at the time of screw down position zero adjustment) equation 1

In equation 1, a cylinder screw down position and casting drum housing screw down system deformation indicate the difference from at the time of screw down position zero adjustment, respectively. The differences may also be deviations from the cylinder screw down position and the casting drum housing deformation at the time of screw down position zero adjustment.

(Cylinder Screw Down Position)

The cylinder screw down position indicates a position of the cylinder in a direction in which the cylinder 120*d* of the continuous casting device 100 moves. For example, the cylinder screw down position is a position by a difference from the initial value that is zero with which zero adjustment of the cylinder position is performed. The cylinder screw down position may be obtained from displacement in a direction along arrow a in FIG. 9. The cylinder screw down position may be timely measured by a position sensor and the like (not illustrated) capable of measuring the amount of movement of the cylinder 120*d* (or the cylinder 120*w*).

(Elastic Deformation of Casting Drum)

The elastic deformation of the casting drum at the time of casting indicates the elastic deformation of the casting drum at an arbitrary time point from the start of the casting to the end of the casting. In the casting drum, deflection occurs on the shaft of the casting drum or flatten deformation occurs on the casting drum due to an influence of a reaction force from the slab that comes into contact with the casting drum or an external force applied to the casting drum. Such deformation is referred to as the elastic deformation of the casting drum at the time of casting. The elastic deformation of the casting drum may be obtained by means such as analysis using an elastic theory.

For example, the deflection of the shaft of the casting drum being the amount of contribution of the drum deformation of the casting drum may be calculated from beam deflection calculation of material mechanics while regarding the casting drum as a both-end supported beam. Regarding load distribution in the width direction used at the time of the deflection calculation, there is no problem in assuming linear distribution in the width direction on the basis of the load cell values provided on both ends of the shaft of the casting drum.

(Casting Drum Housing Screw Down System Deformation)

A casting drum housing screw down system deformation characteristic indicates a deformation characteristic including a characteristic that the housing 130*d* and the housing 130*w* are deformed and a characteristic that a configuration that screws down the casting drum including the cylinder 120*d* and the cylinder 120*w* is deformed under an influence of a screw down load applied to the casting drum. For example, the casting drum housing screw down system deformation characteristic may be obtained by using the method disclosed in Patent Document 5. The casting drum housing screw down system deformation may be calculated on the basis of the load measured by the load cell 140*d* (or the load cell 140*w*) and the like as described later.

(Drum Profile of Casting Drum)

The drum profile of the casting drum is an index indicating an amount of thermal expansion of the casting drum or an amount of wear of the casting drum. In the drum profile of the casting drum, a deformation amount of a surface shape of the casting drum is calculated on the basis of heat applied to the casting drum as the amount of thermal expansion. As the amount of wear, the drum profile before the casting may be actually measured or this may be estimated from a casting condition. For example, since the surface shape when the casting drum is designed is known, the deformation amount of the drum profile may be obtained by adding shape deformation due to thermal expansion and wear to the surface shape.

(Elastic Deformation of Casting Drum at the Time of Screw Down Position Zero Adjustment)

The elastic deformation of the casting drum at the time of screw down position zero adjustment indicates the elastic deformation of the casting drum at the time of screw down position zero adjustment that determines the initial value of the screw down position of the casting drum before the casting starts. Since the screw down position zero adjustment is performed in a state in which the load is applied to the casting drum, the elastic deformation occurs in the casting drum. The elastic deformation amount at that time is made the elastic deformation of the casting drum at the time of screw down position zero adjustment. This elastic deformation amount may be calculated from the beam deflection calculation of material mechanics while regarding the drum as a both-end supported beam as is the case with the elastic deformation of the casting drum at the time of casting.

As described above, the estimated sheet thickness is obtained by subtracting a value of "the elastic deformation of the casting drum at the time of screw down position zero adjustment of the casting drum" from the sum of values of "the cylinder screw down position", "the elastic deformation of the casting drum", "the casting drum housing screw down system deformation", and "the drum profile of the casting drum".

(Obtaining Casting Drum Housing Screw Down System Deformation Characteristic)

Among the items in equation 1 described above, the above-described casting drum housing screw down system deformation characteristic indicating the deformation characteristic of the configuration other than the drum greatly depends on a subtle shape of a contact surface especially in a low load region, and the characteristic easily changes, so that it was difficult to strictly grasp a geometric shape using a known physical model. Therefore, the estimated sheet thickness may be obtained more accurately by obtaining the casting drum housing screw down system deformation characteristic using a method to be described later.

Figure 10:
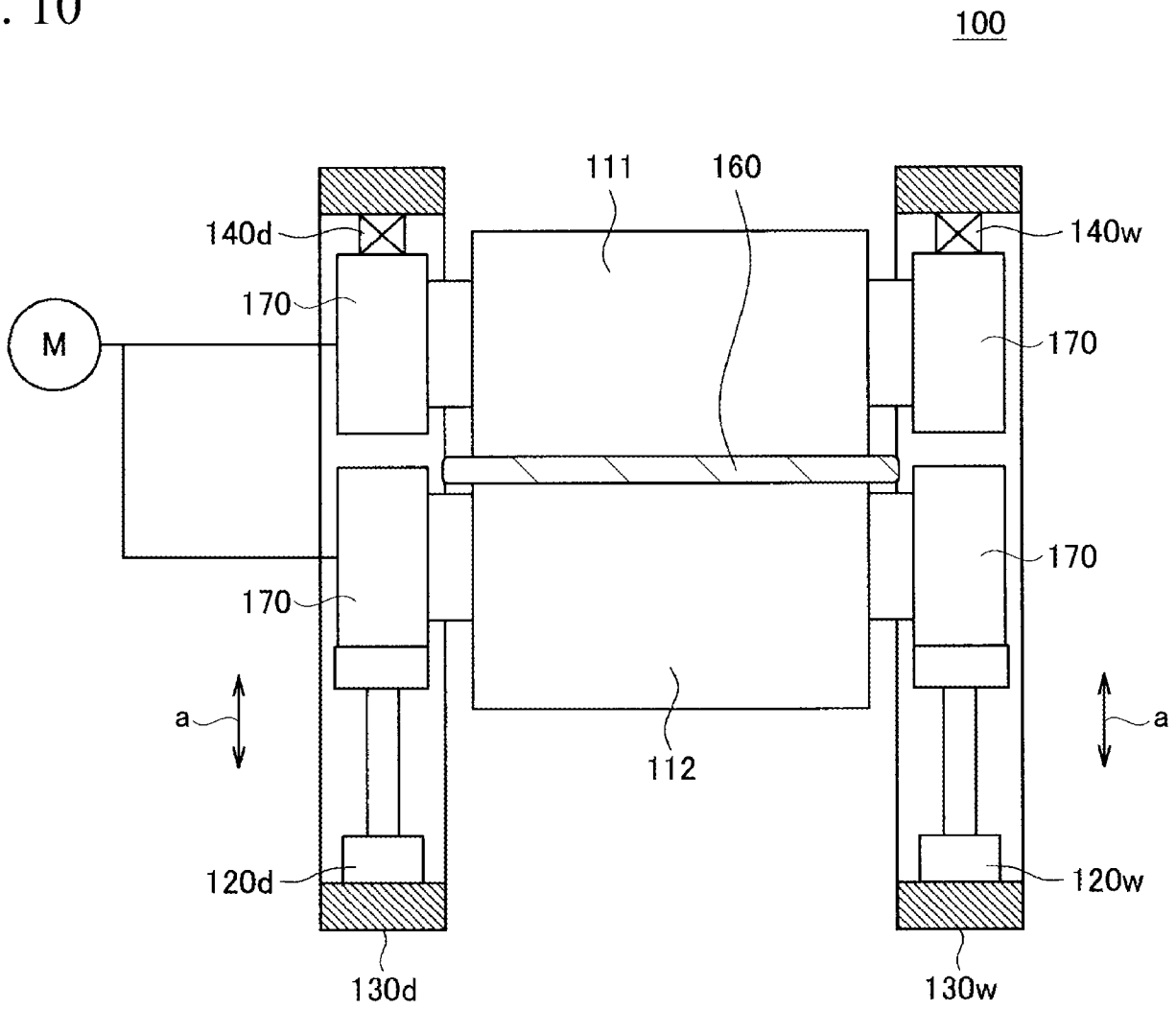
FIG. 10 is a schematic view illustrating an example of obtaining a casting drum housing screw down system deformation characteristic.

In this embodiment, the casting drum housing screw down system deformation characteristic in equation 1 is obtained before the casting of the slab starts. A method of obtaining the casting drum housing screw down system deformation characteristic is described with reference to FIG. 10. FIG. 10 is a view illustrating an example of the method of obtaining the casting drum housing screw down system deformation characteristic.

As illustrated in FIG. 10, the casting drum housing screw down system deformation characteristic is obtained by interposing a test sheet 160 between the first casting drum 111 and the second casting drum 112. The length in a longitudinal direction of the test sheet 160 is longer than the barrel length in the width direction of the casting drum, and the sheet thickness thereof is uniform. From this state, the test sheet 160 is pressed by the first casting drum 111 and the second casting drum 112 by screwing down and tightening by the cylinder 120*d* and the cylinder 120*w*. The length in a direction perpendicular to the longitudinal direction of the test sheet 160 is not limited, but this is preferably about 50 to 100 cm, which is about twice the drum diameter of the first casting drum 111 and the second casting drum 112 so that the test sheet 160 may be sufficiently brought into contact with the first casting drum 111 and the second casting drum 112.

By using the test sheet 160 longer than the barrel length in this manner, it is possible to apply a uniform load to both ends of the casting drum and accurately obtain the casting drum housing roll system deformation characteristic. The casting drum housing roll system deformation characteristic indicates a relationship between a change in load and the deformation amount of the casting drum housing roll system. As a result, it is possible to accurately reflect an influence of the deformation amount with which the roll system including the casting drum housing, the cylinder and the like is deformed according to the load applied to the casting drum at the time of casting in the estimated sheet thickness.

Specifically, this is performed with the test sheet 160 interposed in a state in which the test sheet 160 is interposed between the casting drums and in a state in which the first casting drum 111 and the second casting drum 112 are not rotated. The casting drums are tightened with a predetermined load larger than the load at the time of zero adjustment with respect to the test sheet 160, and the roll position of the casting drum and the load measured by the load cells 140*d* and 140*w* are obtained, and the deformation amount of the casting drum at each load is calculated. Then, by subtracting the deformation amount of the casting drum from the roll position of the casting drum, the casting drum housing roll system deformation amount for each load is obtained. According to this, it is possible to obtain the casting drum housing roll system deformation amount according to the load applied to the slab S when the slab S is cast.

As another method, the first casting drum 111 and the second casting drum 112 are rotated in a state in which the test sheet 160 is interposed therebetween, and the casting drums are tightened with the above-described predetermined load, the load is maintained for a predetermined time, and average values of the load and the screw down position of the casting drum are obtained. Thereafter, furthermore, the load of the casting drum is changed, the changed load is maintained for a predetermined time, and average values of the load at a different level and the screw down position of the casting drum are obtained. Here, the time to maintain each load may be that of two rotations of the casting drum. It is also possible to obtain time series data of the load and the screw down position and calculate the average values from time average thereof. In this manner, the deformation amount of the casting drum at each load is calculated, and the deformation amount of the casting drum is subtracted from the screw down position of the casting drum, so that the casting drum housing screw down system deformation amount for each load is obtained.

The test sheet 160 is more preferably formed of, for example, a material softer than that of the first casting drum 111 and the second casting drum 112 so as not to crush dimples and the like formed on the surfaces of the first casting drum 111 and the second casting drum 112. The test sheet 160 is more preferably formed of, for example, an aluminum alloy, without limitation.

It is sufficient to obtain the casting drum housing screw down system deformation characteristic once before a series of casting operation starts. By performing this in a case where a part of the configuration of the housing or the screw down system is replaced, it is possible to obtain the casting drum housing screw down system deformation characteristic according to a facility condition.

In the screw down position zero adjustment, it is possible to open a pair of side weirs provided on the ends in the width direction of the casting drum, interpose the sheet with the uniform sheet thickness longer than the drum length of the casting drum between the casting drums, and tighten the casting drums as illustrated in FIG. 10. As a result, the slab drum is tightened while a state in which the rotation axes of the casting drums are parallel to each other is maintained, so that a uniform load may be applied to both ends of the casting drum, and the accuracy of the screw down position zero adjustment may be improved. As a result, the screw down position zero adjustment may be performed without including an error due to an inclination of the rotation axis, so that cylinder screw down position control may be performed accurately.

(Slab Casting Method)

Hereinafter, a casting method of a steel sheet by the continuous casting device according to the above-described embodiment is described.

First, before the casting of the slab starts, a pair of side weirs 150*d* and 150*w* provided on the ends in the width direction of the first casting drum 111 and the second casting drum 112 are opened, and a sheet longer than the drum length of the casting drum with a uniform sheet thickness is interposed between the first casting drum 111 and the second casting drum 112, and the casting drums are tightened. Then, by the above-described method, the casting drum housing screw down system deformation characteristic indicating the deformation characteristic of the housing that supports the casting drum and the deformation characteristic of the screw down system that screws down the casting drum is obtained. Note that it is possible to perform the screw down position zero adjustment while obtaining the casting drum housing screw down system deformation characteristic.

Next, a control unit (not illustrated) that controls the continuous casting device 100 calculates the sheet thicknesses at both ends of the slab in the width direction on the basis of equation 1 described above. The continuous casting device 100 is equipped, for example, with various measuring instruments such as a temperature measuring instrument for the first casting drum 111 and the second casting drum 112, and the load cell 140*d* and the load cell 140*w* for measuring the load. The control unit obtains various values from these various measuring instruments and calculates the estimated sheet thicknesses at both ends of the slab from equation 1 described above. Since the control unit may use the casting drum housing screw down system deformation characteristic obtained in advance in equation 1 described above, the estimated sheet thicknesses may be calculated more accurately.

Next, the control unit controls the screw down positions of the cylinders provided on both ends in the width direction of the casting drum so that the calculated difference in sheet thickness between both ends of the slab is equal to or smaller than a predetermined value. As a result, the wedge of the slab to be cast is reduced, and as a result, the meandering in the rolling mill 30 arranged downstream of the continuous casting device 100 may be prevented. Note that a predetermined value of the calculated difference in sheet thickness between both ends of the slab may be experimentally obtained from, for example, the meandering amount that may be tolerated in actual operation. For example, the predetermined value may be 40 μm, and more specifically, 20 μm.

The slab casting method in this embodiment is described above in detail.

EXAMPLES

In this example, in order to confirm an effect of the present disclosure, a slab was cast and rolled using the continuous casting facility 1 described in the embodiment described above. A casting drum used in this example had a drum barrel length of 1,000 mm. For a cylinder position, a pressure, and a sheet thickness, values of a stationary portion were used. Evaluations of a wedge reduction effect were summarized in following Table 1; an absolute value of the wedge was marked as ◎ (excellent) in a case of smaller than 20 μm, ○ (pass) in a case of smaller than 40 μm, and x (fail) in a case of 40 μm or larger.

In example 1, screw down position zero adjustment was performed in a state in which a pair of side weirs provided on ends in a width direction of the casting drum were opened and a sheet with a uniform sheet thickness longer than the drum length of the casting drum was interposed between the casting drums as illustrated in FIG. 10. In Table 1, a method of this screw down position zero adjustment was indicated as A. When casting the slab, screw down positions of cylinders provided on both ends of the casting drum were controlled so that estimated sheet thicknesses on both ends of the slab were the same on right and left sides in the width direction.

In Example 2, as a method of screw down position zero adjustment, a sheet shorter than a drum barrel length of a casting drum was interposed between a pair of casting drums to perform screw down position zero adjustment as illustrated in FIG. 7. In Table 1, this method of screw down position zero adjustment was indicated as B. When casting the slab, screw down positions of cylinders provided on both ends of the casting drum were controlled so that estimated sheet thicknesses on both ends of the slab were the same on right and left sides in the width direction.

In comparative example 1, as in example 2, a sheet shorter than a drum barrel length of a casting drum was interposed between a pair of casting drums to perform screw down position zero adjustment as illustrated in FIG. 7. When casting a slab, screw down positions of cylinders provided on both ends of the casting drum were controlled so that screw down forces on both ends of a slab drum were the same on right and left sides without using estimated sheet thicknesses.

In comparative example 2, as in example 2, a sheet shorter than a drum barrel length of a casting drum was interposed between a pair of casting drums to perform screw down position zero adjustment as illustrated in FIG. 7. When casting a slab, screw down positions of cylinders provided on both ends of the casting drum were controlled so that the screw down positions on both ends of a slab drum were the same on right and left sides without using estimated sheet thicknesses.

In the slab in example 1, the actually measured sheet thicknesses in a stationary portion were 1.820 mm at an end of a drive side DS and 1.830 mm at an end of a work side WS. A wedge (wedge amount) was −10 μm, which was very excellent. Even at a rolling step in a rolling mill installed downstream of the continuous casting device, meandering did not occur and rolling could be carried out without problem.

In the slab in example 2, the actually measured sheet thicknesses in a stationary portion were 1.795 mm at an end of a drive side DS and 1.828 mm at an end of a work side WS. Therefore, the wedge was −33 μm, which was excellent. Even at a rolling step in a rolling mill installed downstream of the continuous casting device, meandering did not occur and rolling could be carried out without problem.

In the slab in comparative example 1, the actually measured sheet thicknesses in a stationary portion were 1.800 mm at an end of a drive side DS and 1.720 mm at an end of a work side WS. The wedge was as large as 80 μm, meandering occurred at a rolling step in a rolling mill installed downstream of the continuous casting device, and the slab broke.

In the slab in comparative example 2, the actually measured sheet thicknesses in a stationary portion were 1.870 mm at an end of a drive side DS and 1.750 mm at an end of a work side WS. The wedge was as large as 120 μm, meandering occurred at a rolling step in a rolling mill installed downstream of the continuous casting device, and the slab broke.

The preferred embodiment of the present disclosure is described above in detail with reference to the accompanying drawings, but the present disclosure is not limited to such example. It is obvious that one of ordinary skill in the technical field to which the present disclosure belongs may conceive of various variations or modifications within the scope of the technical idea recited in claims, and it is understood that they also naturally belong to the technical scope of the present disclosure.

FIELD OF INDUSTRIAL APPLICATION

The present disclosure may provide a slab casting method capable of more accurately reducing a wedge, so that an industrial applicability thereof is high.

BRIEF DESCRIPTION OF THE REFERENCE SYMBOLS

1 Continuous casting facility
20 First pinch roll
30 Rolling mill
31 Upper work roll
32 Lower work roll
33 Upper backup roll

TABLE 1

| | | | ACTUALLY MEASURED VALUE IN STATIONARY PORTION | | | | | | | |
|---|---|---|---|---|---|---|---|---|---|---|
| | ZERO ADJUST- | | CYLINDER POSITION [mm] | | CYLINDER SCREW DOWN FORCE [tonf] | | ACTUALLY MEASURED SHEET THICKNESS [mm] | | WEDGE | EVALUA- |
| | MENT | CONTROL METHOD | DS | WS | DS | WS | DS | WS | [μm] | TION |
| EXAMPLE 1 | A | CONTROL IN WHICH ESTIMATED SHEET THICKNESSES ARE SAME ON RIGHT AND LEFT SIDES | 1.420 | 1.430 | 0.50 | 0.50 | 1.820 | 1.830 | −10 | ◎ |
| EXAMPLE 2 | B | CONTROL IN WHICH ESTIMATED SHEET THICKNESSES ARE SAME ON RIGHT AND LEFT SIDES | 1.395 | 1.620 | 0.50 | 0.54 | 1.795 | 1.828 | −33 | ○ |
| COMPAR-ATIVE EXAMPLE 1 | B | SCREW DOWN FORCES ARE SAME ON RIGHT AND LEFT SIDES | 1.400 | 1.500 | 0.50 | 0.50 | 1.800 | 1.720 | +80 | X |
| COMPAR-ATIVE EXAMPLE 2 | B | SCREW DOWN FORCES ARE SAME ON RIGHT AND LEFT SIDES | 1.450 | 1.450 | 0.60 | 0.30 | 1.870 | 1.750 | +120 | X |

From above, in the casting of the slab by the twin-drum continuous casting device, by calculating the estimated sheet thicknesses from equation 1 described above and controlling the screw down positions of the cylinders so that a difference between both ends of the slab becomes a predetermined value or lower by using the casting drum housing screw down system deformation characteristic indicating the deformation characteristic of the housing that supports the casting drum and the deformation characteristic of the screw down system that screws down the casting drum obtained before the casting of the slab starts, it is possible to more accurately reduce the wedge of the slab and prevent the meandering in the rolling mill installed downstream of the casting drum.

34 Lower backup roll
40 Second pinch roll
50 Coiling device
100 Continuous casting device
111 First casting drum
112 Second casting drum
113 Tundish
114 Immersion nozzle
115 Molten metal pool
116 Solidified shell
117 Molten metal
118 Sheet
120*d*, 120*w* Cylinder
130*d*, 130*w* Housing
140*d*, 140*w* Load cell

150, 150*d*, 150*w* Side weir
160 Test sheet
170 Roll bearing box

What is claimed is:

1. A slab casting method using a twin-drum continuous casting device that manufactures a slab by solidifying molten metal by a pair of rotating casting drums, the method comprising:

calculating estimated sheet thicknesses on both ends in a width direction of the slab from equation 1:

(Estimated sheet thickness)=(cylinder screw down position)+(elastic deformation of casting drum)+(casting drum housing screw down system deformation)+(drum profile of casting drum)−(elastic deformation of casting drum at a time of screw down position zero adjustment) equation 1 wherein the casting drum housing screw down system deformation indicates a deformation characteristic of housings that support the casting drums and a deformation characteristic of a screw down system that screws down the casting drums obtained before casting of the slab starts; and controlling screw down positions of cylinders provided on both ends in a width direction of the casting drums so that a difference in estimated sheet thickness between both the ends becomes a predetermined value or smaller, wherein, in the equation 1, the cylinder screw down position and the casting drum housing screw down system deformation indicate a difference from an initial value at the time of screw down position zero adjustment, respectively, and wherein the casting drum housing screw down system deformation is obtained on the basis of the cylinder screw down positions and a load obtained by tightening in a state of:

opening a pair of side weirs provided on ends in the width direction of the casting drums; and interposing a sheet with a uniform sheet thickness longer in sheet width than a drum length of the casting drums between the casting drums.

2. The slab casting method according to claim 1, wherein the screw down position zero adjustment of the casting drums is performed in the state of opening the pair of side weirs provided on ends in the width direction of the casting drums and interposing the sheet with the uniform sheet thickness longer in sheet width than the drum length of the casting drums between the casting drums.

* * * * *